US011238824B2

(12) United States Patent
Yuan et al.

(10) Patent No.: US 11,238,824 B2
(45) Date of Patent: Feb. 1, 2022

(54) PIXEL CIRCUIT, DRIVING METHOD THEREOF, DISPLAY PANEL, AND DISPLAY APPARATUS

(71) Applicant: BOE TECHNOLOGY GROUP CO., LTD., Beijing (CN)

(72) Inventors: Lijun Yuan, Beijing (CN); Seungwoo Han, Beijing (CN); Guangliang Shang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 455 days.

(21) Appl. No.: 16/332,902

(22) PCT Filed: Sep. 26, 2018

(86) PCT No.: PCT/CN2018/107663
§ 371 (c)(1),
(2) Date: Mar. 13, 2019

(87) PCT Pub. No.: WO2019/205481
PCT Pub. Date: Oct. 31, 2019

(65) Prior Publication Data

US 2021/0335314 A1 Oct. 28, 2021

(30) Foreign Application Priority Data

Apr. 26, 2018 (CN) ..... 201810387124.8

(51) Int. Cl.
*G09G 3/36* (2006.01)

(52) U.S. Cl.
CPC ... *G09G 3/3688* (2013.01); *G09G 2300/0426* (2013.01); *G09G 2300/0439* (2013.01);
(Continued)

(58) Field of Classification Search
CPC ..... G09G 3/3688; G09G 2300/0439; G09G 2300/0426; G09G 2300/0842; G09G 2310/0272
See application file for complete search history.

(56) References Cited

U.S. PATENT DOCUMENTS

2002/0167510 A1 11/2002 Matsumoto
2008/0238855 A1* 10/2008 Teranishi ..... G09G 3/2011 345/98

(Continued)

FOREIGN PATENT DOCUMENTS

CN 101149548 A 3/2008
CN 105425488 A 3/2016
CN 106297686 A 1/2017

OTHER PUBLICATIONS

International Search Report dated Jan. 30, 2019, issued in counterpart application No. PCT/CN2018/107663. (10 pages).

(Continued)

*Primary Examiner* — David Tung
(74) *Attorney, Agent, or Firm* — Westerman, Hattori, Daniels & Adrian, LLP

(57) ABSTRACT

The present disclosure relates to a pixel circuit. The pixel circuit may include a switch sub-circuit (10), a storage sub-circuit (20), and a driving sub-circuit (30). The storage sub-circuit (20) may include a first storage transistor (Tf1) and a second storage transistor (Tf2). Both the first storage transistor (Tf1) and the second storage transistor (Tf2) may be floating gate transistors. The storage sub-circuit (20) and the driving sub-circuit (30) may be configured to transmit a data signal from one of a plurality of data lines to a pixel electrode under control of the switch sub-circuit (10).

19 Claims, 9 Drawing Sheets

(52) U.S. Cl.
CPC ..... *G09G 2300/0842* (2013.01); *G09G 2310/0272* (2013.01)

(56) References Cited

U.S. PATENT DOCUMENTS

| | | | | |
|---|---|---|---|---|
| 2015/0185579 | A1* | 7/2015 | Koyama | G09G 3/3659 349/39 |
| 2017/0124967 | A1* | 5/2017 | Shima | G09G 3/3611 |
| 2017/0124968 | A1* | 5/2017 | Shima | G09G 3/3677 |
| 2017/0124973 | A1* | 5/2017 | Nakao | G09G 3/3655 |
| 2017/0221435 | A1* | 8/2017 | Shima | G09G 3/3648 |
| 2018/0211615 | A1 | 7/2018 | Tan et al. | |

OTHER PUBLICATIONS

Office Action dated May 30, 2019, issued in counterpart CN application No. 201810387124.8, with English translation. (9 pages).

* cited by examiner

PIXEL CIRCUIT, DRIVING METHOD THEREOF, DISPLAY PANEL, AND DISPLAY APPARATUS

CROSS-REFERENCE TO RELATED APPLICATIONS

This application claims benefit of the filing date of Chinese Patent Application No. 201810387124.8 filed on Apr. 26, 2018, the disclosure of which is hereby incorporated in its entirety by reference.

TECHNICAL FIELD

The present disclosure relates to display technologies and, in particular, to a pixel circuit, a driving method thereof, a display panel, and a display apparatus.

BACKGROUND

Memory In Pixel (MIP) technology is a technology used to reduce the power consumption of display apparatus. In the display apparatus using the MIP technology, a pixel circuit is disposed in each pixel. When the image displayed by the display apparatus is a still image, the source driving circuit can be controlled to stop outputting the data signal, and the data voltage of the pixel electrode is maintained by the pixel circuit, thereby reducing the power consumption of the display apparatus.

In related art, in a display apparatus using the MIP technology, a pixel circuit generally includes a plurality of transistors, and the plurality of transistors may constitute a phase locked loop for storing a data voltage of the pixel electrode when the image displayed by the display apparatus is a still image.

However, the structure of the pixel circuit of the display apparatus in the related art is complicated, and the occupied area is large, which is disadvantageous for the realization of the high-resolution display apparatus.

BRIEF SUMMARY

An embodiment of the present disclosure provides pixel circuit. The pixel circuit may include a switch sub-circuit, a storage sub-circuit, and a driving sub-circuit. The storage sub-circuit may include a first storage transistor and a second storage transistor, and the first storage transistor and the second storage transistor may be floating gate transistors. The storage sub-circuit and the driving sub-circuit may be configured to transmit a data signal from one of a plurality of data lines to a pixel electrode under control of the switch sub-circuit.

The switch sub-circuit may be respectively coupled to a first gate line, a first power signal line, a second power signal line, a first switch node and a second switch node, and the switch sub-circuit may be configured to input a first power signal from the first power signal line to the first switch node and a second power signal from the second power signal line to the second switch node under control of a first gate drive signal from the first gate line.

The plurality of data lines may include a first data line and a second data line. The storage sub-circuit may be respectively coupled to the first switch node, the second switch node, the first data line, the second data line, and a storage node, and the storage sub-circuit may be configured to electrically couple the first data line with the storage node in response to a voltage signal of the first switch node, or to electrically couple the second data line with the storage node in response to a voltage signal of the second switch node.

The driving sub-circuit may be respectively coupled to a second gate line, the storage node and the pixel electrode, and the driving sub-circuit may be configured to write a potential of the storage node to the pixel electrode under control of a second gate driving signal from the second gate line. A gate of the first storage transistor may be coupled to the first switch node, a first terminal of the first storage transistor may be coupled to the first data line, and a second terminal of the first storage transistor may be coupled to the storage node. A gate of the second storage transistor may be coupled to the second switch node, a first terminal of the second storage transistor may be coupled to the second data line, and a second terminal of the second storage transistor may be coupled to the storage node.

The switch sub-circuit may include a first switch transistor and second switch transistor. A gate of the first switch transistor may be coupled to the first gate line, a first terminal of the first switch transistor may be coupled to the first power signal line, and a second terminal of the first switch transistor may be coupled to the first switch node. A gate of the second switch transistor may be coupled to the first gate line, a first terminal of the second switch transistor may be coupled to the second power signal line, and a second terminal of the second switch transistor may be coupled to the second switch node.

The driving sub-circuit may include a driving transistor, a gate of the driving transistor may be coupled to the second gate line, a first terminal of the driving transistor may be coupled to the storage node, and a second terminal of the driving transistor may be coupled to the pixel electrode.

The pixel electrode may use liquid crystals as a dielectric layer to form a liquid crystal capacitor Clc with a common electrode Vc, and a metal coupled to the pixel electrode may use an insulating layer as a dielectric layer to form a storage capacitor Cst with the common electrode Vc.

A target data line, which is one of the first data line and the second data line, may be respectively coupled to a first pulse signal terminal and a source driving circuit, and the other one of the first data line and the second data line may be coupled to a second pulse signal terminal. The first pulse signal terminal and the second pulse signal terminal may be respectively configured to output a pulse data signal, and the source driving circuit is configured to output a display data signal Another example of the present disclosure is a display panel. The display panel may include a plurality of pixels. Each of the plurality of the pixels may include the pixel circuit according to one embodiment of the present disclosure.

The plurality of the pixels may be arranged in an array, the pixel circuit in each of the plurality of pixels of a same row may be respectively coupled to two gate lines; and the pixel circuit in each of the plurality of the pixels of a same column may be respectively coupled to two data lines and two power signal lines.

Another example of the present disclosure is a display apparatus. The display apparatus may include the display panel according to one embodiment of the present disclosure.

Another example of the present disclosure is a method of driving a pixel circuit. The method of driving a pixel circuit may include a writing phase. In the writing phase, the switch sub-circuit may input a first power signal from the first power signal line to the first switch node and a second power signal from the second power signal line to the second switch node under the control of the first gate drive signal. One of a potential of the first power signal or a potential of the second power signal may be in a first range, and the other one of the potential of the first power signal or the potential of the second power signal may be in a second range, and the first range and the second range do not overlap. The first range may be from about 20 volts (V) to about 30 V, and the second range may be from about −30 volts (V) to about −20 V. In the writing phase, the storage sub-circuit may electrically couple the first data line with the storage node in response to a voltage signal of the first switch node, and the first data line may input the first data signal to the storage node. Alternatively, the storage sub-circuit may electrically couple the second data line with the storage node in response to a voltage signal of the second switch node, and the second data line may input a second data signal to the storage node.

The method may further include a display phase. In the display phase, the second gate driving signal may be at a first potential, and the driving sub-circuit may write the potential of the storage node to the pixel electrode under control of the second gate driving signal. In the writing phase and the displaying phase, one of the first storage transistor or the second storage transistor may remain in an on state, and correspondingly, one of the first data line or the second data line may continuously input a data signal to the storage node.

The pixel circuit may have a low frequency driving mode and a normal driving mode. In the normal driving mode, the data signal outputted by one of the first data line and the second data line may be a display data signal provided by the source driving circuit.

In one embodiment, when a color of an image to be displayed of the pixel in which the pixel circuit is located is a first color, the potential of the first power signal is in the first range, and the potential of the second power signal is in the second range, the first storage transistor is turned on, and the second storage transistor is turned off In one embodiment, when a color of an image to be displayed of the pixel in which the pixel circuit is located is a second color, the potential of the first power signal is in the second range, and the potential of the second power signal is in the first range, the second storage transistor is turned on, and the first storage transistor is turned off.

BRIEF DESCRIPTION OF THE DRAWINGS

In order to more clearly illustrate the embodiments of the present disclosure or the technical solutions in the prior art, the drawings used in the embodiments or the description of the prior art will be briefly described below. Obviously, the drawings in the following description are only certain embodiments of the present disclosure, and other drawings can be obtained from those skilled in the art without any creative work.

DETAILED DESCRIPTION

Figure 1:
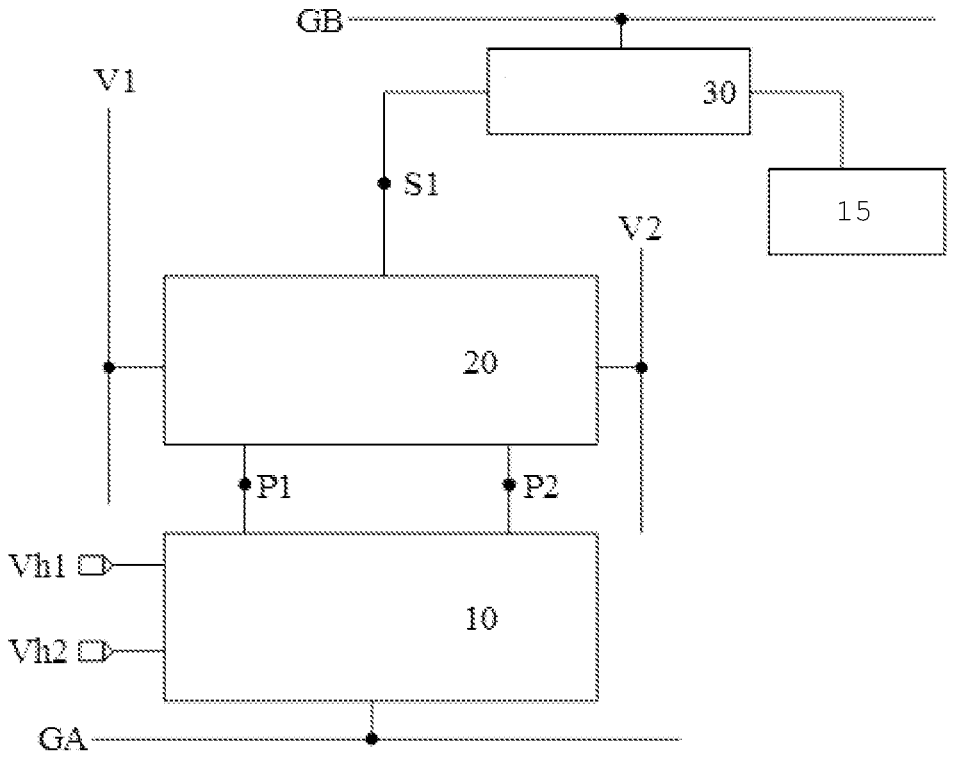
FIG. 1 is a schematic structural diagram of a pixel circuit according to one embodiment of the present disclosure.

The present disclosure will be described in further detail with reference to the accompanying drawings and embodiments in order to provide a better understanding by those skilled in the art of the technical solutions of the present disclosure. Throughout the description of the disclosure, reference is made to FIGS. 1-8. When referring to the figures, like structures and elements shown throughout are indicated with like reference numerals.

In the description of the specification, references made to the term "some embodiment," "some embodiments," and "exemplary embodiments," "example," and "specific example," or "some examples" and the like are intended to refer that specific features and structures, materials or characteristics described in connection with the embodiment or example that are included in at least some embodiments or example of the present disclosure. The schematic expression of the terms does not necessarily refer to the same embodiment or example. Moreover, the specific features, structures, materials or characteristics described may be included in any suitable manner in any one or more embodiments or examples.

The transistors used in all the embodiments of the present disclosure may be thin film transistors or field effect transistors or other apparatus having the same characteristics. The transistors used in the embodiments of the present disclosure are mainly switch transistors according to the functions in the circuit. Since source and drain of the switch transistor used here are symmetrical, the source and the drain are interchangeable. In the embodiments of the present disclosure, the source is referred to as a first terminal, and the drain is referred to as a second terminal. According to the drawing, the middle terminal of the transistor is the gate, the signal input terminal is the source, and the signal output terminal is the drain. In addition, the switch transistor used in the embodiments of the present disclosure may include any one of a P-type switch transistor or an N-type switch transistor. The P-type switch transistor is turned on when the gate is at a low level, and is turned off when the gate is at a high level. The N-type switch transistor is turned on when the gate is at a high level and turned off when the gate is at a low level. Furthermore, the plurality of signals in various embodiments of the present disclosure has a first potential and a second potential. The first potential and the second potential only represent two states of the potential of the signal, and do not mean that the first potential or the second potential has a specific value in the whole disclosure.

FIG. 1 is a schematic structural diagram of a pixel circuit according to one embodiment of the present disclosure. As shown in FIG. 1, the pixel circuit may include a switch sub-circuit 10, a storage sub-circuit 20, and a driving sub-circuit 30.

In one embodiment, the switch sub-circuit 10 is respectively coupled to a first gate line GA, a first power signal line Vh1, a second power signal line Vh2, a first switch node P1, and a second switch node P2. The switch sub-circuit 10 may be configured to input a first power signal from the first power signal line Vh1 to the first switch node P1 and to input a second power signal from the second power signal line Vh2 to the second switch node P2 under the control of a first gate drive signal from the first gate line GA.

In the embodiment, the switch sub-circuit 10 can input the first power signal and the second power signal to the first switch node P1 and the second switch node P2, respectively, when the first gate drive signal is at the first potential. Moreover, the potential of the first power signal is in a different range from the potential of the second power signal. For example, when the potential of the first power signal is in the range of about 20 volts (V) to about 30 V, the potential of the second power signal may be in the range of about −30V to about −20V. Correspondingly, when the potential of the first power signal is in the range of about −30V to about −20V, the potential of the second power signal can be in the range of about 20V to about 30V.

In one embodiment, the storage sub-circuit 20 is respectively coupled to the first switch node P1, the second switch node P2, the first data line V1, the second data line V2, and the storage node S1. The storage sub-circuit 20 is configured to electrically couple the first data line V1 with the storage node S1 in response to the voltage signal of the first switch node P1, or the storage sub-circuit 20 is configured to electrically couple the second data line V2 with the storage node S1 in response to the voltage signal of the second switch node P2.

In one embodiment, the storage sub-circuit 20 can electrically couple the first data line V1 and the storage node S1 when the potential of the voltage signal of the first switch node P1 is in the first range, and electrically couple the second data line V2 and the storage node S1 when the potential of the voltage signal of the second switch node P2 is in the first range. The first range can be −30V to −20V.

In one embodiment, the driving sub-circuit 30 is respectively coupled to the second gate line GB, the storage node S1 and a pixel electrode 15 for writing the potential of the storage node S1 to the pixel electrode under the control of the second gate driving signal from the second gate line GB.

In one embodiment, the driving sub-circuit 30 can electrically couple the storage node S1 and the pixel electrode 15 when the second gate driving signal is at the first potential, thereby writing the potential of the storage node S1 to the pixel electrode 15. When the storage sub-circuit 20 electrically couples the first data line V1 and the storage node S1, the potential written by the driving sub-circuit 30 to the pixel electrode 15 is also the first data signal from the first data line V1. When the storage sub-circuit 20 electrically couples the second data line V2 and the storage node S1, the potential written by the driving sub-circuit 30 to the pixel electrode 15 is also the second data signal from the second data line V2.

The embodiments of the present disclosure provide a pixel circuit including a switch sub-circuit, a storage sub-circuit, and a driving sub-circuit. The switch sub-circuit can control the potentials of the first switch node and the second switch node. The storage sub-circuit can electrically couple the storage node with the first data line or the second data line under the control of the two switch nodes so that the first data line or the second data line can continuously input a data signal to the storage node. When the source driving circuit stops outputting the data signal and needs to maintain the data voltage of the pixel electrode, there is no need to form a phase locked loop in the pixel circuit. Thus, the structure of the pixel circuit is relatively simple, and the occupied area is small, which is beneficial to realization of the high-resolution display apparatus.

Figure 2:
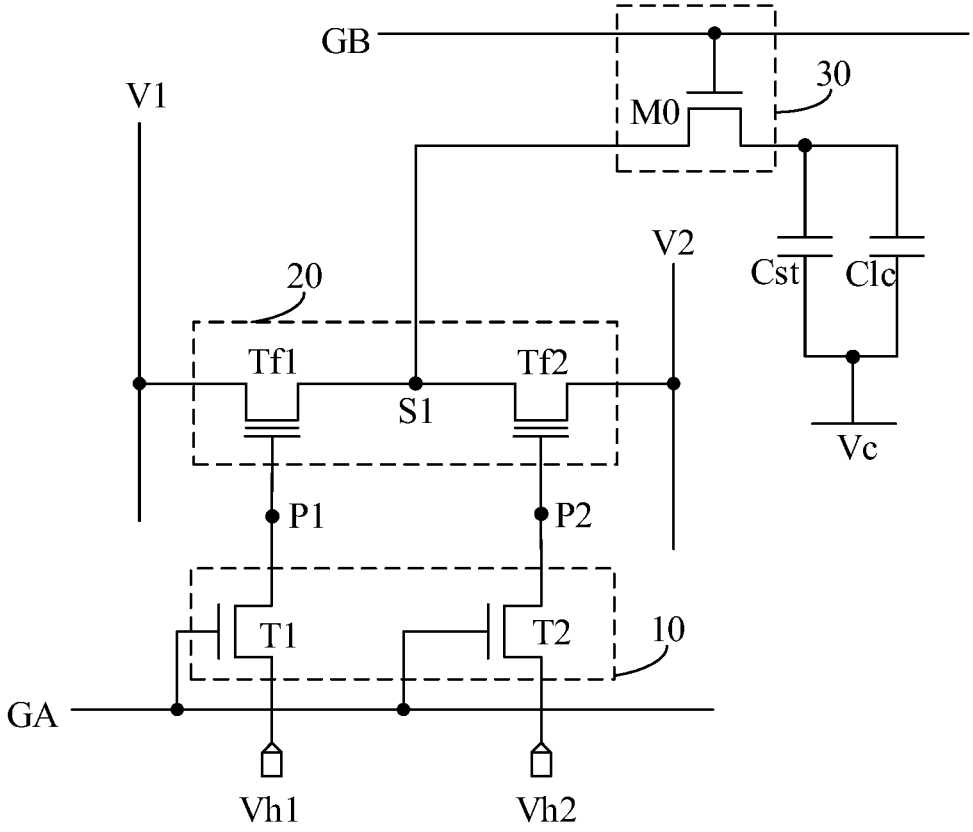
FIG. 2 is a schematic structural diagram of a pixel circuit according to one embodiment of the present disclosure.

FIG. 2 is a schematic structural diagram of a pixel circuit according to one embodiment of the present disclosure. In one embodiment, as shown in FIG. 2, the storage sub-circuit 20 may include a first storage transistor Tf1 and a second storage transistor T2. The first storage transistor Tf1 and the second storage transistor Tf2 may both be floating gate transistors.

The floating gate transistor is provided with two gates. One of the two gates is a control gate, which has an electrical connection. The other one of the two gates is a floating gate, which is between the control gate and the transistor channel. The floating gate is surrounded by an insulating layer and not coupled with any external leads, that is, it is floated. The control gate adjusts the threshold voltage of the transistor by controlling the electronic transition from the substrate to the floating gate by high voltage (or low voltage), thereby changing the external characteristics of the floating gate transistor.

Figure 3:
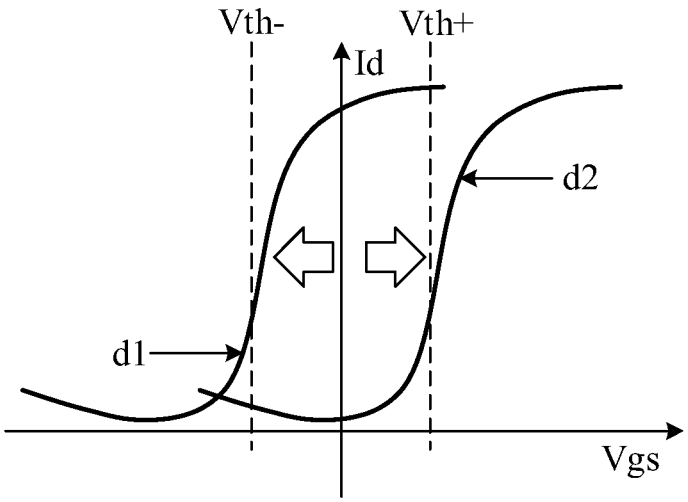
FIG. 3 is a schematic diagram of a drain current of a floating gate transistor as a function of a gate-to-source voltage difference.

FIG. 3 is a schematic diagram of a drain current Id vs a gate-source voltage difference Vgs of a floating gate transistor according to one embodiment of the present disclosure. When the potential of the voltage signal on the gate (that is, the control gate) of the floating gate transistor is in the first range, as shown by the curve d1 in FIG. 3, the threshold voltage of the floating gate transistor is negatively shifted. That is, at this time, its threshold voltage Vth− is negative, and the floating gate transistor can be turned on. When the potential of the voltage signal on the control gate of the floating gate transistor is in the second range, as shown by the curve d2 in FIG. 3, the threshold voltage of the floating gate transistor is positively shifted. That is, its threshold voltage Vth+ is positive, and the floating gate transistor can be turned off (ie, off state).

In one embodiment, with reference to FIG. 2, the gate of the first storage transistor Tf1 may be coupled to the first switch node P1, the first terminal of the first storage transistor Tf1 is coupled to the first data line V1, and the second terminal of the first storage transistor Tf1 is coupled to the storage node S1.

If the potential of the first switch node P1 is in the first range, the threshold voltage of the first storage transistor Tf1 is negatively shifted, and the first storage transistor Tf1 is turned on. Moreover, when the voltage signal on the first switch node P1 is removed, the first storage transistor Tf1 can remain open. If the potential of the first switch node P1 is in the second range, the threshold voltage of the first storage transistor Tf1 is positively shifted, and the first storage transistor remains off.

In one embodiment, the gate of the second storage transistor Tf2 is coupled to the second switch node P2, a first terminal of the second storage transistor Tf2 is coupled to the second data line V2, and a second terminal of the second storage transistor Tf2 is coupled to the storage node S1.

Similarly, if the potential of the second switch node P2 is in the first range, the threshold voltage of the second storage transistor Tf2 is negatively shifted, and the second storage transistor Tf2 is turned on. Moreover, when the voltage signal loaded on the second switch node P2 is removed, the second storage transistor Tf2 can remain open. If the potential of the second switch node P2 is in the second range, the threshold voltage of the second storage transistor Tf2 is positively shifted and the second storage transistor remains off.

In some embodiments, as shown in FIG. 2, the switch sub-circuit 10 may include: a first switch transistor T1 and a second switch transistor T2. A gate of the first switch transistor T1 is coupled to the first gate line GA, a first terminal of the first switch transistor T1 is coupled to the first power signal line Vh1, and a second terminal of the first switch transistor T1 is coupled to the first switch node P1.

The first switch transistor T1 can be turned on when the first gate driving signal provided by the first gate line GA is at the first potential, and electrically couples the first power line Vh1 and the first switch node P1.

In one embodiment, the gate of the second switch transistor T2 is coupled to the first gate line GA, a first terminal of the second switch transistor T2 is coupled to the second power signal line Vh2, and a second terminal of the second switch transistor T2 is coupled to the second switching node P2.

The second switch transistor T2 can be turned on when the first gate driving signal provided by the first gate line GA is at the first potential, and the second power supply line Vh2 is electrically coupled to the second switch node P2.

In some embodiments, as shown in FIG. 2, the driving sub-circuit 30 may include a driving transistor M0. The gate of the driving transistor M0 is coupled to the second gate line GB. The first terminal of the driving transistor M0 is coupled to the storage node S1, and the second terminal of the driving transistor M0 is coupled to the pixel electrode. The driving transistor M0 can be turned on when the second gate driving signal provided by the second gate line GB is at the first potential, thereby electrically coupling the storage node S1 and the pixel electrode.

Referring to FIG. 2, the pixel electrode can use a material such as liquid crystals (LC) as a dielectric layer to form a liquid crystal capacitor Clc with a common electrode Vc in the display panel. Moreover, the pixel electrode or the metal coupled to the pixel electrode can also use an insulating layer as a dielectric layer to form a storage capacitor Cst with a common electrode or other metal electrode in the display panel.

In some embodiments, a target data line, which is one of the first data line V1 and the second data line V2, may be respectively coupled to the first pulse signal terminal and the source driving circuit, and the other data line other than the target data line may be coupled with the second pulse signal terminal. The target data line may be any data line of the first data line V1 and the second data line V2.

The first pulse signal terminal and the second pulse signal terminal may be used to output a pulse data signal. For example, the first pulse signal terminal may be used to output a normally white signal, and the second pulse signal terminal may be used to output a normally black signal. The source driving circuit is configured to output a display data signal. Therefore, the target data line can realize time division multiplexing, thereby effectively reducing the wiring cost of the display apparatus.

Some embodiments of the present disclosure provide a pixel circuit including a switch sub-circuit, a storage sub-circuit, and a driving sub-circuit. The switch sub-circuit can control the potentials of the first switch node and the second switch node, and the storage sub-circuit can electrically couple the storage node with the first data line or the second data line under the control of the two switch nodes. As such, the first data line or the second data line can continuously input a data signal to the storage node. When the source driving circuit stops outputting the data signal and needs to maintain the data voltage of the pixel electrode, there is no need to form a phase-locked loop in the pixel circuit. As a result, the circuit structure of the pixel circuit is relatively simple, and the occupied area is small, which is beneficial to realization of the high-resolution display apparatus.

Figure 4:
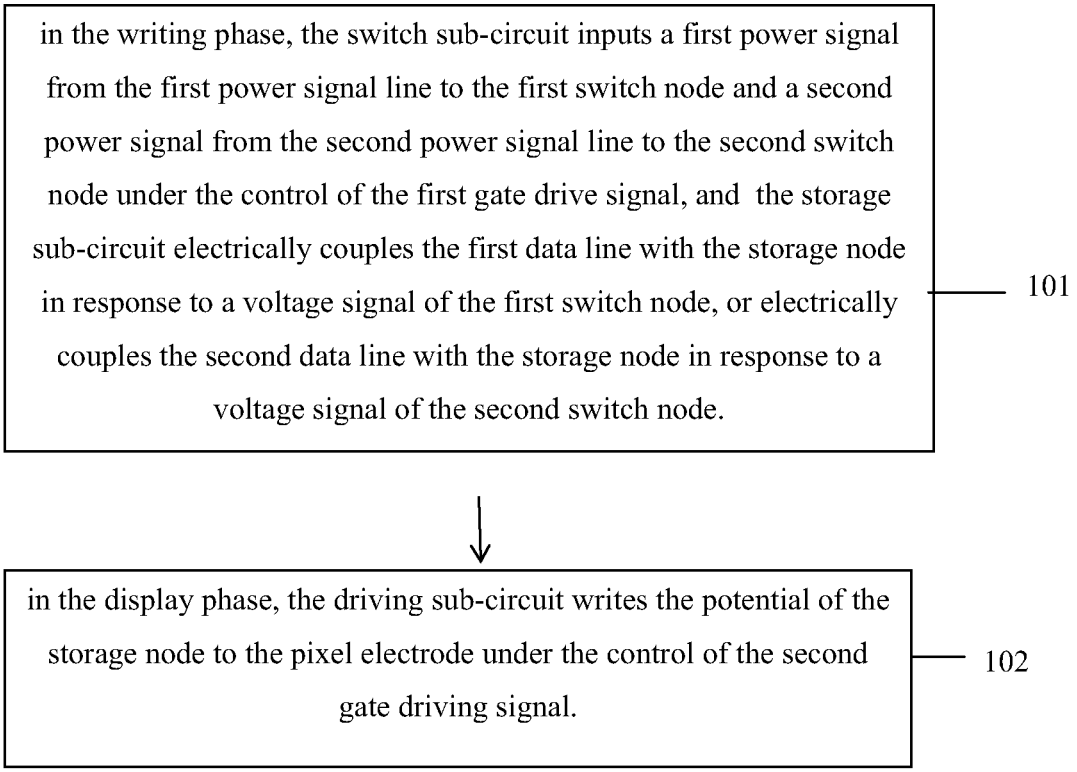
FIG. 4 is a flowchart of a driving method of a pixel circuit according to one embodiment of the present disclosure.

FIG. 4 is a flowchart of a method for driving a pixel circuit according to one embodiment of the present disclosure, which may be used to drive the pixel circuit shown in FIG. 1 or FIG. 2. As shown in FIG. 4, the method includes the following:

Step 101: in the writing phase, the first gate driving signal outputted by the first gate line is at a first potential, and the second gate driving signal outputted by the second gate line is at a second potential. The switch sub-circuit inputs a first power signal from the first power signal line to the first switch node and a second power signal from the second power signal line to the second switch node under the control of the first gate drive signal. The potential of the first power signal is different from the potential of the second power signal. The storage sub-circuit electrically couples the first data line with the storage node in response to the voltage signal of the first switch node, and the first data line inputs the first data signal to the storage node. Alternatively, the storage sub-circuit electrically couples the second data line with the storage node in response to the voltage signal of the second switch node, and the second data line inputs the second data signal to the storage node.

Step 102: in the display phase, the second gate driving signal is at a first potential, and the driving sub-circuit writes the potential of the storage node to the pixel electrode under the control of the second gate driving signal.

In some embodiments, a driving method of a pixel circuit is provided. The pixel circuit can electrically couple a first data line or a second data line with a storage node in a writing phase, thereby enabling the first data line or the second data line to continuously input a data signal to the storage node. When the source driving circuit stops outputting the data signal and needs to maintain the data voltage of the pixel electrode, there is no need to form a phase-locked loop in the pixel circuit. Accordingly, the driving process is relatively simple.

In some embodiments, as shown in FIG. 2, the storage sub-circuit 20 may include: a first storage transistor Tf1 coupled to the first data line V1, and a second storage transistor Tf2 coupled to the second data line V2. The first storage transistor Tf1 and the second storage Transistor Tf2 each may be a floating gate transistor.

In the writing phase shown in the above step 101, the potential of a target power signal, which is one of the first power signal and the second power signal, is in the first range, and the potential of the other power signal is in the second range. The target storage transistor is one of the first storage transistor or the second storage transistor that is coupled to the target switch node, and the target storage transistor is turned on. The target switch node is one of the first switch node and the second switch node into which the target power signal is written.

In some embodiments, the potential of the first power signal is in the first range during the writing phase, and the first switch node P1 being written the first power signal can drive the first storage transistor Tf1 to turn on.

In the writing phase and the display phase, the target storage transistor can be continuously maintained in an on state, and the signal line, one of the first data line and the second data line, coupled to the target storage transistor can further continuously input data signals to the storage node. For example, the first data line V1 can continuously input the first data signal to the storage node S1 through the first storage transistor Tf1.

The first range and the second range do not overlap. For example, the first range may be −30V to −20V, and the second range may be 20V to 30V.

In some embodiments, as shown in FIG. 2, the switch sub-circuit 10 may include a first switch transistor T1 and a second switch transistor T2.

In the writing phase, the first gate driving signal is at a first potential, the first switch transistor T1 and the second switch transistor T2 are turned on, and the first power signal line Vh1 inputs the first power signal to the first switch node P1 through the first switch transistor T1, and the second power signal line Vh2 inputs the second power signal to the second switch node P2 through the second switch transistor T2.

Among the two power signals, the potential of one power signal may be in a first range, and the potential of the other power signal may be in a second range.

In some embodiments, as shown in FIG. 2, the driving sub-circuit 30 may include: a driving transistor M0.

In the display phase, the second gate driving signal is at a first potential, the driving transistor M0 is turned on, and the driving transistor M0 writes the potential of the storage node S1 to the pixel electrode.

Figure 5:
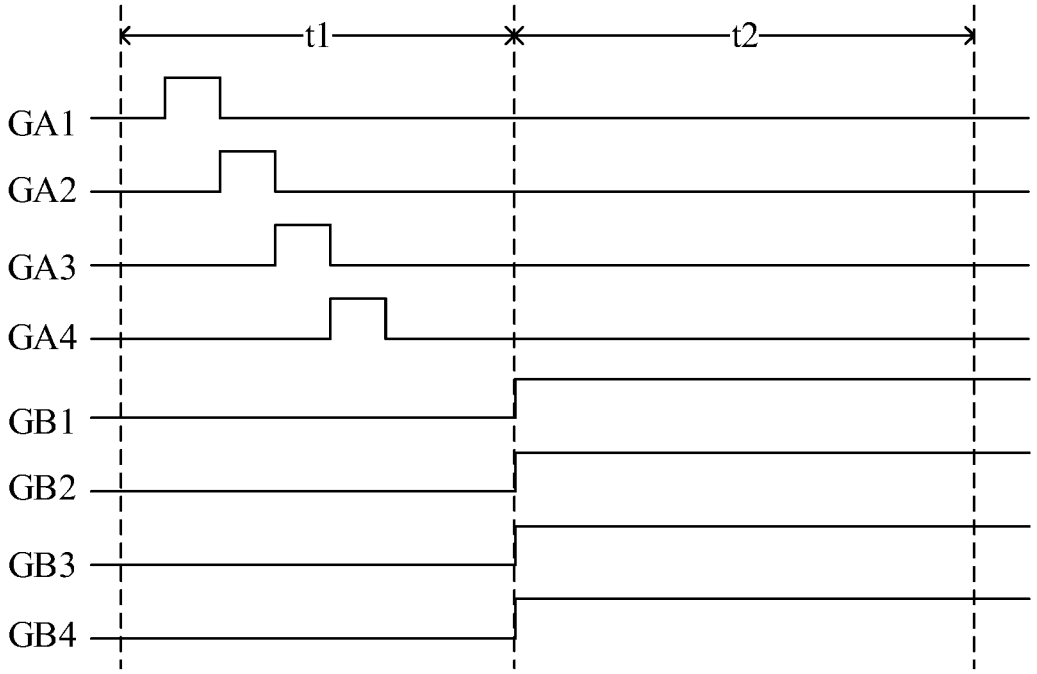
FIG. 5 is a timing diagram of a first gate driving signal and a second gate driving signal in a pixel circuit according to one embodiment of the present disclosure.

Taking the pixel circuit shown in FIG. 2 as an example, and each transistor being an N-type transistor, the first potential is high with respect to the second potential as an example, the driving method of the pixel circuit provided by the embodiment of the present disclosure is described in detail below. FIG. 5 is a timing diagram of a first gate driving signal and a second gate driving signal in a pixel circuit according to one embodiment of the present disclosure. It is assumed that the pixel to which the pixel circuit belongs is located in the first row of the display panel, and the first gate line and the second gate line coupled to the pixel circuit are respectively GA1 and GB1.

Referring to FIG. 2 and FIG. 5, in the writing phase t1, the first gate driving signal provided by the first gate line GA1 is the first potential, and the second gate driving signal provided by the second gate line GB1 is the second potential. The first switch transistor T1 and the second switch transistor T2 are turned on, and the driving transistor M0 is turned off. The first power signal line Vh1 inputs a first power signal to the first switch node P1, and the second power signal line Vh2 inputs a second power signal to the second switch node P2.

Figure 6:
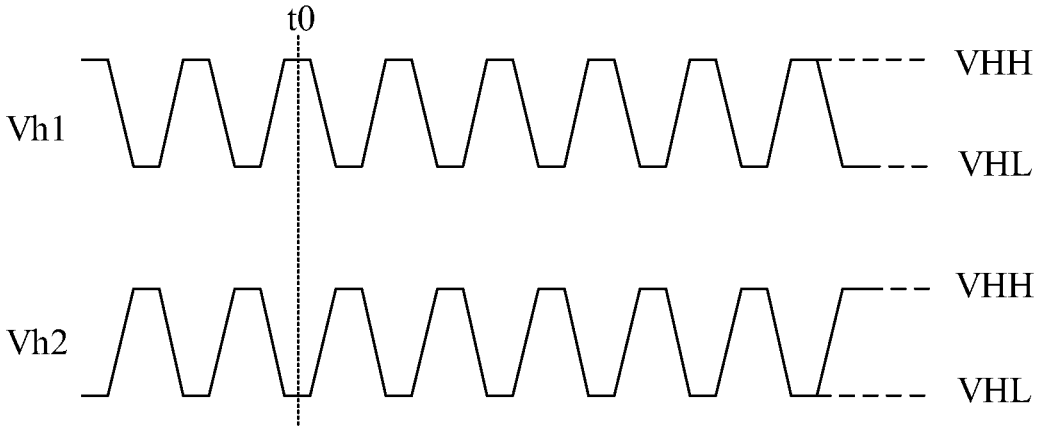
FIG. 6 is a timing diagram of a first power signal and a second power signal according to one embodiment of the present disclosure.

FIG. 6 is a timing diagram of a first power signal and a second power signal according to one embodiment of the present disclosure. Referring to FIG. 6, in the first power signal outputted by the first power signal terminal Vh1 and the second power signal outputted by the second power signal terminal Vh2, the variation range of the potential of each power signal may be VHL to VHH. Wherein the potential range of VHL may be the first range, for example, may be −30V to −20V; the potential range of VHH may be the second range, for example, 20V to 30V. Moreover, as can be seen from FIG. 6, the potentials of the two power supply signals are different at the same time. For example, at time t0, the potential of the first power signal is in the second range, and the potential of the second power signal is in the first range.

The timing and potential range of the power signals outputted by the two power signal terminals can also be adjusted according to actual conditions. For example, in the timing shown in FIG. 6, the timings of the two power signals can also be interchanged.

In some embodiments, in response to the voltage signal of the first switch node P1 (ie, the first power signal), the first storage transistor Tf1 can be turned on, the first data line V1 is electrically coupled with the storage node S1, and the first data line V1 inputs the first data signal to the storage node S1. Alternatively, in response to the voltage signal of the second switch node P2 (ie, the second power signal), the second storage transistor Tf2 may be turned on, the second data line V2 is electrically coupled with the storage node S1, and the second data line V2 can inputs a second data signal to the storage node S1.

In one embodiment, in the writing phase t1, the potential of the first power signal is in the first range (for example, −30V to −20V), and the potential of the second power signal is in the second range (for example, 20V to 30V). Then, in response to the first power signal of the first switch node P1, the threshold voltage of the first storage transistor Tf1 is negatively shifted, that is, the threshold voltage Vth− of the first storage transistor Tf1 is negative at this time. As such, the transistor Tf1 is turned on, and the first data line V1 can write the first data signal into the storage node S1. At the same time, in response to the second power signal of the second switch node P2, the threshold voltage of the second storage transistor Tf2 is positively shifted, that is, the threshold voltage Vth+ of the second storage transistor Tf2 is positive at this time. As such, the second storage transistor Tf2 is turned off.

In one embodiment, as shown in FIG. 5, in the display phase t2, the potential of the second gate driving signal outputted by the second gate line GB1 is changed from the second potential to the first potential. As such, the driving transistor M0 is turned on by the second gate driving signal, and the potential of the storage node S1 is written into the pixel electrode.

In some embodiments, if the first storage transistor Tf1 is turned on in the writing phase t1, the first storage transistor Tf1 remains an "on" state in the display phase t2, and the first data line V1 can continuously input the first data signal to the pixel electrode through the first storage transistor Tf1 and the driving transistor M0.

In some embodiments, the driving mode of the pixel circuit may include at least a low frequency driving mode and a normal driving mode. In the normal drive mode (for example, the refreshing frequency is 60 Hz), the source drive circuit is in operation, and outputs normal display data signal. When the image displayed by the display apparatus is a still image, the display apparatus can activate the low frequency driving mode (the refreshing frequency can be 30 Hz or lower). In the low frequency driving mode, the source driving circuit is disabled, and no display data signal is output in the disabled phase.

In some embodiments, in the low frequency driving mode, the first data signal outputted by the first data line V1 may be a pulse signal provided by one of the first pulse signal terminal and the second pulse signal terminal. The second data signal outputted by the second data line V2 may be a pulse signal provided by the other one of the pulse signal terminals. For example, the first data line V1 may be coupled to the first pulse signal terminal, and the second data line V2 may be coupled to the second pulse signal terminal. Moreover, the first pulse signal outputted by the first pulse signal terminal may be a normally white signal, and the second pulse signal outputted by the second pulse signal terminal may be a normally black signal.

In the normal driving mode, the data signal output by the target data line, which is one of the first data line V1 and the second data line V2, is the display data signal provided by the source driving circuit. Moreover, in the normal driving mode, the storage transistor coupled to the target data line remains in an on state, and the other storage transistor remains in an off state, thereby ensuring that the first data line V1 can write the display data signal to the pixel electrode.

In one embodiment, the target data line is the first data line V1. In the normal driving mode, the first power signal provided by the first power signal line Vh1 and the second power signal provided by the second power signal line Vh2 may be adjusted to control the first storage transistor Tf1 coupled to the first data line V1 to remain in a normally open state and the second storage transistor Tf2 to remain in an off state. As such, it is ensured that the display data signal provided by the first data line V1 can be normally written to the pixel electrode.

In the embodiment, since the target data line is coupled to both the pulse signal terminal and the source driving circuit, the target data line can output different data signals in different driving modes, thereby realizing time division multiplexing and reducing wiring cost of the display apparatus.

Furthermore, in the writing phase t1 of the low frequency driving mode, when the color of the image to be displayed of the pixel in which the pixel circuit is located is a first color such as a white color, the potential of the first power signal outputted by the first power signal terminal Vh1 may be in a first range, and the potential of the second power signal outputted by the second power signal terminal Vh2 may be in the second range. At this time, the first storage transistor Tf1 is turned on, and the second storage transistor Tf2 is turned off.

In one embodiment, the first storage transistor Tf1 may input a first pulse signal from the first data line V1, that is, a normally white signal, to the storage node S1. When the driving transistor M0 is turned on, the normally white signal may be written to the pixel electrode and stored in the storage Capacitor Cst.

When the color of the image to be displayed of the pixel in the pixel circuit is a second color such as a black color, the potential of the first power signal outputted by the first power signal terminal Vh1 may be in the second range, and the potential of the second power signal outputted by the second power signal terminal Vh2 is in the first range. At this time, the second storage transistor Tf2 is turned on, and the first storage transistor Tf1 is turned off.

In some embodiments, the second storage transistor Tf2 may input a second pulse signal, that is, a normally black signal, from the second data line V2 to the storage node S1. When the driving transistor M0 is turned on, the normally black signal may be written to the pixel electrode, and stored in the storage capacitor Cst.

According to the above analysis, in the writing phase of the low frequency driving mode, the display apparatus can adjust the range of the potential of the first power signal provided by the first power signal terminal Vh1 and the range of the potential of the second power signal provided by the second power signal terminal Vh2 based on the color of the image to be displayed for each pixel. Therefore, the first storage transistor Tf1 can be turned on or the second storage transistor Tf2 can be turned on, thereby controlling the first data line V1 or the second data line V2 to be electrically coupled with the storage node S1, and finally controlling the signal written to the storage node S1.

Optionally, in the low frequency driving mode, because the driving frequency is low, in order to prevent the liquid crystalS from deteriorating while maintaining a deflection direction for a long time, the display apparatus may further adjust the polarity of the first data signal and the polarity of the second data signal according to a preset period, thereby enabling adjustment of the polarity of the liquid crystals.

Figure 7:
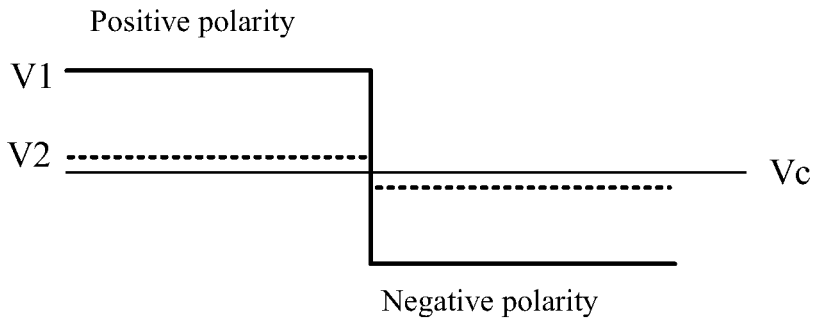
FIG. 7 is a timing diagram of a first data signal and a second data signal according to one embodiment of the present disclosure.

FIG. 7 is a timing diagram of a first data signal and a second data signal according to one embodiment of the present disclosure. Referring to FIG. 7, the polarity of each data signal may include a positive polarity and a negative polarity. The positive polarity means that the potential of the data signal is high with respect to the potential of the common electrode Vc; and the negative line means that the potential of the data signal is low with respect to the potential of the common electrode Vc.

In some embodiments, in the low frequency driving mode, the polarities of the first data signal and the second data signal are both positive, and after the preset period of time, the display apparatus can adjust the polarities of the first data signal and the second data signal to be negative polarity.

It should be noted that, in the above embodiments, the description is made by taking an example in which each transistor is an N-type transistor and the first potential is a high potential with respect to the second potential. Certainly, each of the transistors may also adopt a P-type transistor. When the P-type transistors are used in the respective transistors, the first potential may be a low potential relative to the second potential, and the potential change of each signal terminal can be opposite to the potential change shown in FIG. 5 (that is, the phase difference between the two is 180 degrees).

Some embodiments of the present disclosure provide a method of driving a pixel circuit, which can electrically couple a first data line or a second data line with a storage node in a writing phase, thereby ensuring that the first data line or the second data line can continuously input a data signal to the storage node. When the source driving circuit stops outputting the data signal and needs to maintain the data voltage of the pixel electrode, there is no need to form a phase-locked loop in the pixel circuit. Accordingly, the driving process is relatively simple.

Another example of the present disclosure is a display panel. The display panel may include a plurality of pixels, each of which may include a pixel circuit as shown in FIG. 1 or 2.

Figure 9:
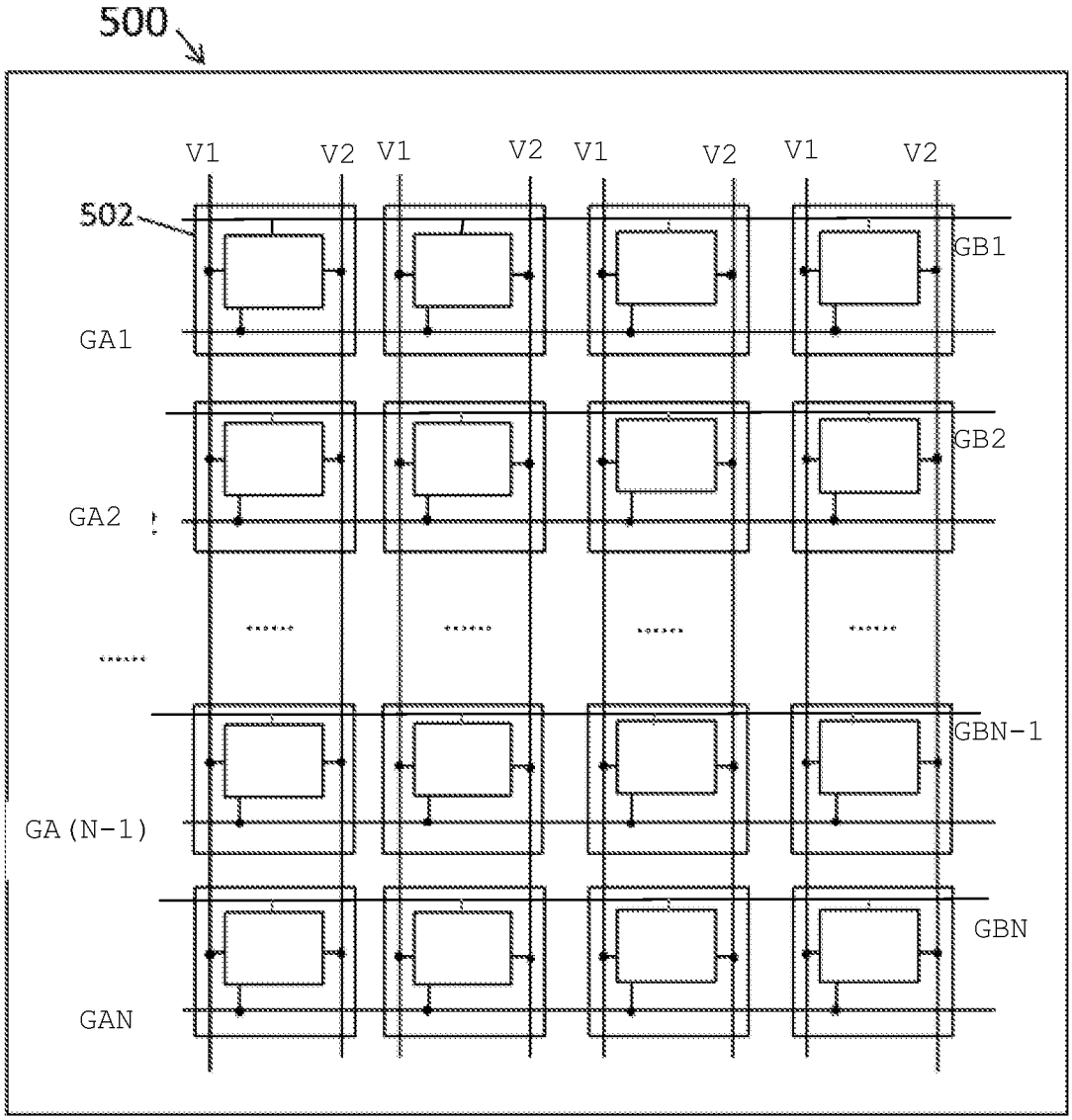
FIG. 9 is a schematic structural diagram of a display panel according to one embodiment of the present disclosure

FIG. 9 is a schematic structural diagram of a display panel according to some embodiments of the present disclosure. As shown in FIG. 9, the display panel 500 includes a plurality of pixel units 502. At least one of the pixel units 502 includes a pixel circuit according to one embodiment of the present disclosure In some embodiments, the array substrate may further include a plurality of gate lines, GA1, GA2 . . . GA (N−1), GA N. The plurality of pixel units 502 are arranged in an array. Switch sub-circuits of the pixel units arranged in a same row are coupled to a same gate line.

In some embodiments, as shown in FIG. 9, among the plurality of pixels, the pixel circuits in the same row are respectively coupled to the two gate lines GA and GB. Among the plurality of pixels, the pixel circuits in the same column are respectively coupled to the two data lines V1 and V2 and the two power signal lines.

In the writing phase t1, the first gate line coupled to each row of pixels can output the first gate driving signal at the first potential row by row. The potential of the second gate driving signal outputted by the second gate line to which each row of pixels is coupled may be the second potential.

In the display phase t2 of the normal driving mode, the potential of the second gate driving signal outputted by the second gate line coupled to each row of pixels may be jumped from the second potential to the first potential row by row. The driving transistors in the pixel circuits of the pixels of each row are turned on row by row, and the potentials of the storage nodes are respectively written to the corresponding pixel electrodes.

In some embodiments, referring to FIG. 5, for the first four rows of pixels in the display panel, each pixel circuit in the first row of pixels may be respectively coupled to the first gate line GA1 and the second gate line GB1; each pixel circuit in the second row of pixels may be respectively coupled to the first gate line GA2 and the second gate line GB2; each pixel circuit in the third row of pixels may be respectively coupled to the first gate line GA3 and the second gate line GB3; and each pixel circuit in the fourth row of pixels may be respectively coupled to the first gate line GA4 and the second gate line GB4.

In the writing phase t1, the first gate line GA1 to the first gate line GA4 may output the first gate driving signal at the first potential row by row. The second gate driving signals output from the second gate line GB1 to the second gate line GB4 are all the second potential.

In some embodiments, in the display phase t2 of the low frequency driving mode, as shown in FIG. 5, the potential of the second gate driving signal outputted by the second gate line GB1 to the second gate line GB4 can be simultaneously jumped from the second potential to the first potential. The driving transistors in the pixel circuits of the four rows of pixels are simultaneously turned on, and the potentials of the storage nodes are respectively written to the corresponding pixel electrodes.

Figure 8:
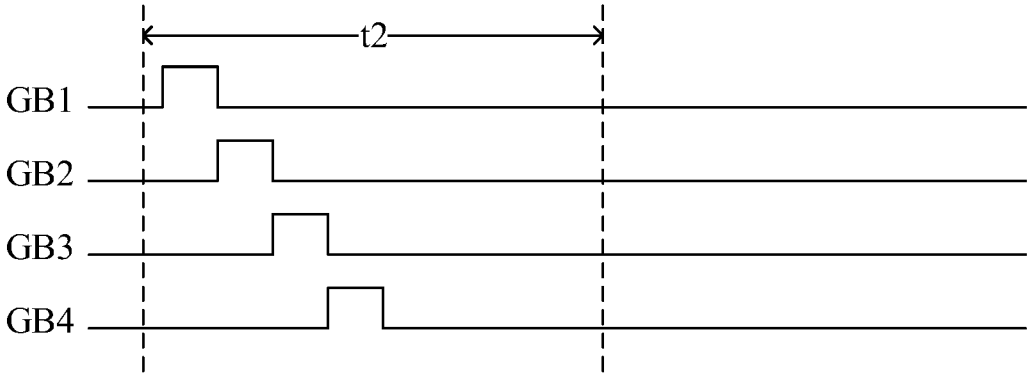
FIG. 8 is a timing diagram of a second gate driving signal according to one embodiment of the present disclosure.

In some embodiments, in the display phase t2 of the normal driving mode, as shown in FIG. 8, the potentials of the second gate driving signals output from the second gate line GB1 to the second gate line GB4 may be jumped from the second potential to the first potential row by row. The driving transistors in the pixel circuits of the four rows of pixels are turned on row by row, and the potentials of the storage nodes are respectively written to the corresponding pixel electrodes.

Since the display data signals written by the respective pixels may not be the same in the normal driving mode, it is necessary to control the second gate lines to be turned on line by line to ensure the display effect of the display apparatus.

Another example of the present disclosure is a display apparatus. The display apparatus includes the display panel according to one embodiment of the present disclosure. The display panel includes a plurality of pixels, each of which may include a pixel circuit as shown in FIG. 1 or FIG. 2. The display apparatus can be any product or component having a display function, such as a liquid crystal panel, an electronic paper, an OLED panel, an AMOLED panel, a mobile phone, a tablet computer, a television, a display, a notebook computer, a digital photo frame, a navigator, and the like.

An embodiment of the present disclosure provides a computer readable storage medium having instructions stored therein. When the computer readable storage medium is run on a computer, the computer is caused to perform a driving method of the pixel circuit as provided by the above method embodiments.

The principle and the embodiment of the present disclosures are set forth in the specification. The description of the embodiments of the present disclosure is only used to help understand the method of the present disclosure and the core idea thereof. Meanwhile, for a person of ordinary skill in the art, the disclosure relates to the scope of the disclosure, and the technical scheme is not limited to the specific combination of the technical features, and also should covered other technical schemes which are formed by combining the technical features or the equivalent features of the technical features without departing from the inventive concept. For example, technical scheme may be obtained by replacing the features described above as disclosed in this disclosure (but not limited to) with similar features.

What is claimed is:

1. A pixel circuit, comprising a switch sub-circuit;

a storage sub-circuit, the storage sub-circuit comprising a first storage transistor and a second storage transistor, the first storage transistor and the second storage transistor being floating gate transistors; and a driving sub-circuit, wherein the storage sub-circuit and the driving sub-circuit are configured to transmit a data signal from one of a plurality of data lines to a pixel electrode under control of the switch sub-circuit; and the switch sub-circuit is respectively coupled to a first gate line, a first power signal line, a second power signal line, a first switch node and a second switch node, and the switch sub-circuit is configured to input a first power signal from the first power signal line to the first switch node and a second power signal from the second power signal line to the second switch node under control of a first gate drive signal from the first gate line.

2. The pixel circuit of claim 1, wherein the plurality of data lines comprises a first data line and a second data line, the storage sub-circuit is respectively coupled to the first switch node, the second switch node, the first data line, the second data line, and a storage node, and the storage sub-circuit is configured to electrically couple the first data line with the storage node in response to a voltage signal of the first switch node, or to electrically couple the second data line with the storage node in response to a voltage signal of the second switch node.

3. The pixel circuit of claim 2, wherein the driving sub-circuit is respectively coupled to a second gate line, the storage node and the pixel electrode, and the driving sub-circuit is configured to write a potential of the storage node to the pixel electrode under control of a second gate driving signal from the second gate line.

4. The pixel circuit of claim 3, wherein the driving sub-circuit comprises a driving transistor, a gate of the driving transistor is coupled to the second gate line, a first terminal of the driving transistor is coupled to the storage node, and a second terminal of the driving transistor is coupled to the pixel electrode.

5. The pixel circuit of claim 2, wherein a gate of the first storage transistor is coupled to the first switch node, a first terminal of the first storage transistor is coupled to the first data line, and a second terminal of the first storage transistor is coupled to the storage node; and a gate of the second storage transistor is coupled to the second switch node, a first terminal of the second storage transistor is coupled to the second data line, and a second terminal of the second storage transistor is coupled to the storage node.

6. The pixel circuit of claim 1, wherein the switch sub-circuit comprises a first switch transistor and second switch transistor;

a gate of the first switch transistor is coupled to the first gate line, a first terminal of the first switch transistor is coupled to the first power signal line, and a second terminal of the first switch transistor is coupled to the first switch node; and a gate of the second switch transistor is coupled to the first gate line, a first terminal of the second switch transistor is coupled to the second power signal line, and a second terminal of the second switch transistor is coupled to the second switch node.

7. The pixel circuit of claim 1, wherein the pixel electrode uses liquid crystals as a dielectric layer to form a liquid crystal capacitor Clc with a common electrode Vc, and a metal coupled to the pixel electrode uses an insulating layer as a dielectric layer to form a storage capacitor Cst with the common electrode Vc.

8. The pixel circuit of claim 1, wherein a target data line, which is one of the first data line and the second data line, is respectively coupled to a first pulse signal terminal and a source driving circuit, and the other one of the first data line and the second data line is coupled to a second pulse signal terminal;

the first pulse signal terminal and the second pulse signal terminal are respectively configured to output a pulse data signal, and the source driving circuit is configured to output a display data signal.

9. A display panel, comprising a plurality of pixels, each of the plurality of the pixels comprising the pixel circuit of claim 1.

10. The display panel of claim 9, wherein the plurality of the pixels is arranged in an array, the pixel circuit in each of the plurality of pixels of a same row is respectively coupled to two gate lines; and the pixel circuit in each of the plurality of the pixels of a same column is respectively coupled to two data lines and two power signal lines.

11. A display apparatus, comprising the display panel according to claim 9.

12. A method of driving a pixel circuit according to claim 1, the method comprising a writing phase, wherein, in the writing phase, the switch sub-circuit inputs a first power signal from the first power signal line to the first switch node and a second power signal from the second power signal line to the second switch node under the control of the first gate drive signal, and one of a potential of the first power signal or a potential of the second power signal is in a first range, and the other one of the potential of the first power signal or the potential of the second power signal is in a second range, and the first range and the second range do not overlap.

13. The method of claim 12, wherein, the first range is from about 20 volts (V) to about 30 V, and the second range is from about −30 volts (V) to about −20 V.

14. The method of claim 12, wherein, in the writing phase, the storage sub-circuit electrically couples the first data line with the storage node in response to a voltage signal of the first switch node, and the first data line inputs the first data signal to the storage node; or the storage sub-circuit electrically couples the second data line with the storage node in response to a voltage signal of the second switch node, and the second data line inputs a second data signal to the storage node.

15. The method of claim 14, further comprising a display phase, wherein, in the display phase, the second gate driving signal is at a first potential, and the driving sub-circuit writes the potential of the storage node to the pixel electrode under control of the second gate driving signal.

16. The method of claim 15, wherein in the writing phase and the displaying phase, one of the first storage transistor or the second storage transistor remains in an on state, and correspondingly, one of the first data line or the second data line continuously input a data signal to the storage node.

17. The method of claim 16, wherein the pixel circuit has a low frequency driving mode and a normal driving mode;

in the normal driving mode, the data signal outputted by one of the first data line and the second data line is a display data signal provided by the source driving circuit.

18. The method of claim 17, wherein when a color of an image to be displayed of the pixel in which the pixel circuit is located is a first color, the potential of the first power signal is in the first range, and the potential of the second power signal is in the second range, the first storage transistor is turned on, and the second storage transistor is turned off.

19. The method of claim 18, wherein when a color of an image to be displayed of the pixel in which the pixel circuit is located is a second color, the potential of the first power signal is in the second range, and the potential of the second power signal is in the first range, the second storage transistor is turned on, and the first storage transistor is turned off.

* * * * *